US006912807B2

(12) United States Patent
Meyerle et al.

(10) Patent No.: US 6,912,807 B2
(45) Date of Patent: Jul. 5, 2005

(54) FIREARMS SAFETY DEVICE

(75) Inventors: Herbert Meyerle, Maisach (DE); Bernd Dietel, Weissenstadt (DE)

(73) Assignee: Armatix GmbH, Unterfohring (DE)

( * ) Notice: Subject to any disclaimer, the term of this patent is extended or adjusted under 35 U.S.C. 154(b) by 0 days.

(21) Appl. No.: 10/618,260

(22) Filed: Jul. 11, 2003

(65) Prior Publication Data

US 2004/0074131 A1 Apr. 22, 2004

(30) Foreign Application Priority Data

Jul. 12, 2002 (DE) ..... 102 31 685
Aug. 30, 2002 (DE) ..... 102 40 119

(51) Int. Cl.[7] ..... F41A 17/00
(52) U.S. Cl. ..... 42/70.11
(58) Field of Search ..... 42/70.11, 96

(56) References Cited

U.S. PATENT DOCUMENTS 2,327,334 A * 8/1943 Parker ..... 42/70.11
2,479,107 A * 8/1949 Garretson ..... 42/76.01

(Continued)

FOREIGN PATENT DOCUMENTS

| | | | |
|---|---|---|---|
| DE | 35 34 583 C2 | | 4/1986 |
| DE | G 90 01 066.3 | | 4/1990 |
| DE | 39 37 042 C2 | | 10/1990 |
| DE | 40 13 124 C2 | | 10/1991 |
| DE | G 94 05 724.9 | | 9/1994 |
| DE | 689 15 858 T2 | | 11/1994 |
| DE | G 94 16 556.4 | | 1/1995 |
| DE | 44 02 951 C2 | | 8/1995 |
| DE | 44 33 337 A1 | | 3/1996 |
| DE | 44 36 799 C2 | | 4/1996 |
| DE | 19957160 | * | 11/1999 |
| DE | 29920918 | * | 11/1999 |
| DE | 100 14 687 C1 | | 3/2000 |
| DE | 200 05 798 U1 | | 8/2000 |
| DE | 29920895 | * | 10/2000 |
| DE | 299 20 895 U1 | | 10/2000 |
| DE | 199 57 160 C1 | | 2/2001 |
| DE | 195 23 399 C2 | | 4/2001 |
| DE | 299 20 918 U1 | | 5/2001 |
| EP | 0 343 115 B1 | | 6/1994 |
| EP | 0 825 408 A2 | | 2/1998 |
| GB | 2215822 | * | 9/1989 |
| GB | 2234047 | * | 1/1991 |
| WO | WO 98/01716 | | 1/1998 |
| WO | WO 98/55817 | | 12/1998 |
| WO | WO 01/06198 | | 1/2001 |
| WO | WO 01/79777 | | 10/2001 |
| WO | WO 02/08683 | | 1/2002 |

OTHER PUBLICATIONS

"Office Action" from German Priority Application No. 10240119.5–15.

"Office Action" from German Priority Application No. 10231685.6–15.

"Search Report" from PCT/US03/07549.

*Primary Examiner*—Michael Carone
*Assistant Examiner*—Daniel Lawson Greene, Jr.
(74) *Attorney, Agent, or Firm*—Westman, Champlin!& Kelly, P.A.

(57) ABSTRACT

The invention relates to a safety device and a securing method, in particular for securing firearms against unauthorised use. A device according to the invention is provided with at least one clamping or locking portion that is insertable into a barrel 100 of a firearm and is optionally lockable and/or unlockable or permanently clampable therein and/or detachable therefrom. Moreover, it is provided with a control unit, such as an electronic authentication means that is capable of authenticating a user and, if the user is authorized, makes at least one clamping portion clampable within the barrel of the weapon or detachable therefrom. The safety device is completely insertable into the barrel.

46 Claims, 3 Drawing Sheets

Figure 1:
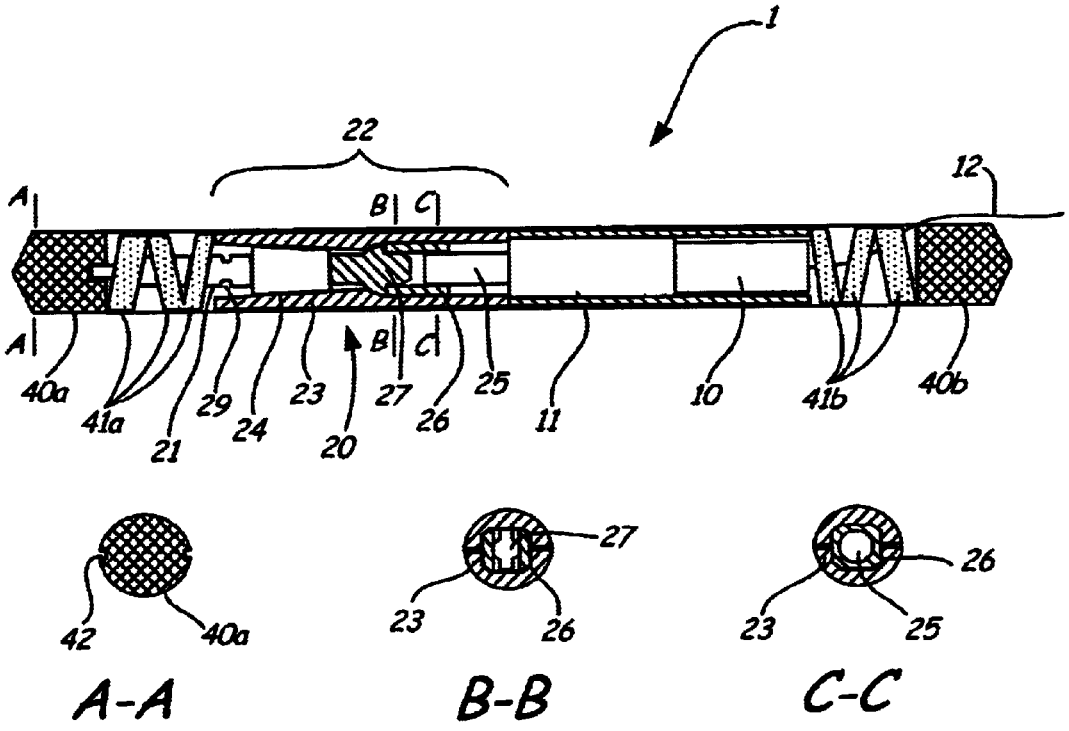

U.S. PATENT DOCUMENTS 4,023,294 A * 5/1977 Knopp ..... 42/70.11
4,266,356 A * 5/1981 Jarvinen Uro T. ..... 42/70.11
4,398,366 A * 8/1983 Wernicki ..... 42/70.11
4,512,099 A * 4/1985 Mathew ..... 42/70.11
4,783,924 A * 11/1988 Thurber ..... 42/70.11
4,908,971 A * 3/1990 Chaney ..... 42/70.11
4,969,284 A * 11/1990 Healey et al. ..... 42/70.11
5,048,211 A * 9/1991 Hepp ..... 42/70.11
5,052,142 A * 10/1991 Mikus ..... 42/70.11
5,054,223 A * 10/1991 Lee ..... 42/70.11
5,233,777 A * 8/1993 Waterman et al. ..... 42/70.11
5,289,653 A * 3/1994 Szebeni et al. ..... 42/70.11
5,398,438 A * 3/1995 Williams ..... 42/70.11
5,438,907 A * 8/1995 Reynolds et al. ..... 89/14.5
5,491,918 A * 2/1996 Elmstedt ..... 42/70.11
5,537,771 A * 7/1996 Martin ..... 42/70.01
5,664,358 A * 9/1997 Haber et al. ..... 42/70.11
5,699,687 A * 12/1997 Pittman ..... 70/376
5,860,241 A * 1/1999 Waters ..... 42/70.11
5,890,310 A * 4/1999 Bogstrom ..... 42/70.11
6,098,330 A * 8/2000 Schmitt et al. ..... 42/70.11
6,131,326 A * 10/2000 Case ..... 42/96
6,202,336 B1 * 3/2001 Audino ..... 42/70.11
6,223,566 B1 * 5/2001 Jamison ..... 70/11
6,311,422 B1 * 11/2001 Exum et al. ..... 42/70.11
6,374,527 B1 * 4/2002 Finardi ..... 42/70.11
6,405,472 B1 * 6/2002 Dojcsak ..... 42/70.11
6,477,801 B1 * 11/2002 O'dwyer ..... 42/70.11
6,502,344 B1 * 1/2003 Zeh et al. ..... 42/70.11
6,526,684 B1 * 3/2003 Hickerson ..... 42/70.11
6,530,306 B1 * 3/2003 LaFleur ..... 89/188
6,560,910 B1 * 5/2003 McLaren ..... 42/70.11
6,584,718 B1 * 7/2003 Serrao ..... 42/70.11
6,604,313 B1 * 8/2003 Kress ..... 42/70.11
6,634,130 B1 * 10/2003 Balchunas ..... 42/70.11
6,698,126 B2 * 3/2004 Worley ..... 42/70.11
6,701,655 B2 * 3/2004 Milo ..... 42/70.11
2002/0032976 A1 3/2002 Riener ..... 42/70.11

* cited by examiner

FIREARMS SAFETY DEVICE

The present application is based on and claims the benefit of German patent application Ser. Nos. 10231685.6 and 10240119.5, filed Jul. 12, 2002 and Aug. 30, 2002, respectively, the contents of which are hereby incorporated by reference in their entirety.

The present invention relates to a safety device for firearms, in particular for being inserted into the barrel of a firearm.

Devices for securing firearms against unauthorised use are disclosed in DE 299 20 895 U1, DE 199 57 160 C1 and DE 299 20 918 U1. These documents relate to inserts that are used in firearm barrels and are only removable by electrical discharge.

According to DE 299 20 895 U1, a locking portion is to this end inserted into the muzzle end of a barrel, said locking portion comprising a head engaging with the muzzle and consisting of a material that is merely workable by electrical discharge. A rod extending into the magazine is rigidly connected to this head and moreover, the magazine end of the rod is rigidly connected to an insert within the magazine. Said insert has a diameter that is larger than that of the barrel bore and consists of a material that cannot be machine-drilled. The rod extends through the entire barrel and is secured against being detached by the insert at the magazine end and by the locking portion at the barrel end.

DE 199 57 160 C1 and DE 299 20 918 U1 describe the use of an expanding sleeve. A first expanding device is releasably inserted into one end of the expanding sleeve which is thereby pressed against the inner wall of the barrel so that it gets jammed. A second expanding device is inserted into the other end of the expanding sleeve. If the second expanding means is subjected to axial pressure, the expanding sleeve and the inner wall of the barrel interlock. The one end of the expanding sleeve is covered by a protective disc which can only by destroyed by electrical discharge if the expanding sleeve is to be removed from the barrel.

Firearms safety devices according to the aforementioned prior art references, however, can also be removed from the firearm barrels by unauthorised people by sawing off the front portion of the barrel (DE 299 20 895 U1) or if they possess EDM equipment. Consequently, they do not effectively and permanently secure the previously secured firearms against unauthorised use. Moreover, it is extremely complicated for authorised people to remove these prior art firearms safety devices if the firearms are to be re-used. Using them for putting weapons in use (such as sporting weapons) at safe is unthinkable.

In view of this prior art, it is the object of the present invention to provide improved firearms safety devices and an improved method of putting firearms at safe.

This object is achieved by the features according to the claims.

The invention is based on the idea of providing a safety device, in particular for firearms, against unauthorised use comprising at least one clamping or locking portion that is insertable into a tube, an oblong recess, a firearm barrel or the like and is optionally lockable and/or unlockable or tightly clampable therein and/or detachable therefrom. Moreover, a control unit, preferably an electronic authentication means, is provided that is capable of identifying a user and, if the user is authorised, makes at least the clamping portion clampable in the tube, the oblong recess, the firearm barrel or the like and detachable therefrom. Preferably, the safety device is completely insertable into the barrel of a firearm.

Moreover, an activation and deactivation means may be provided which, upon authentication by the control unit, enables or prevents locking and/or unlocking or clamping and/or detachment via a transmission means that is accessible from outside and protected against manipulation. This is preferably effected by a deactivation element which has a movement from outside for activating a mechanism inside the safety device transmitted to the mechanism or prevents such a transmission This is preferably achieved by coupling or decoupling or blocking said movement.

Furthermore, the invention relates to severance protection means provided in the locking portion. Due to this severance protection means, the locking portion at least partially radially expands upon locking or clamping in case of an essentially axial force caused by manipulation so that the locking portion is locked or clamped farther into the barrel and/or the cartridge chamber.

Moreover, the invention relates to any combination of the embodiments mentioned above and the respective methods.

The subject-matter of the present invention shows remarkable advantages vis-a-vis the prior art, i.e. that a weapon may be secured against unauthorized use reliably but nevertheless quickly, extreme resistance may be put up to violent manipulations and "intelligent" manipulations by the subject-matter of the invention and the production of a firearms safety device according to the invention is nonetheless economical.

Moreover, a safety device according to the invention has a low susceptibility to manipulation and effectively puts a weapon at safe, irrespective of the barrel length of the weapon. Furthermore, the safety device is invisible from outside for being within the barrel and is therefore particularly suitable for weapons that are used as decoration, such as inherited weapons.

Figure 2A:
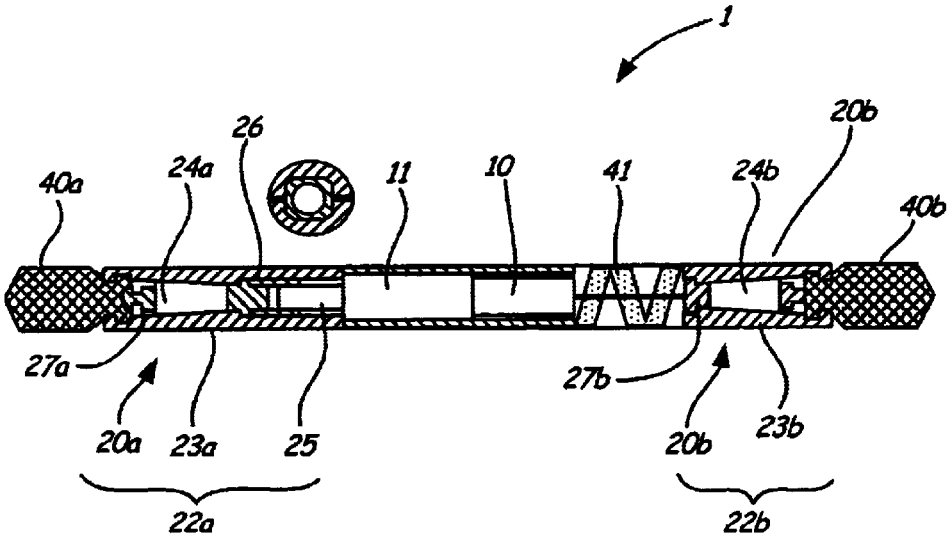
Figure 2B:
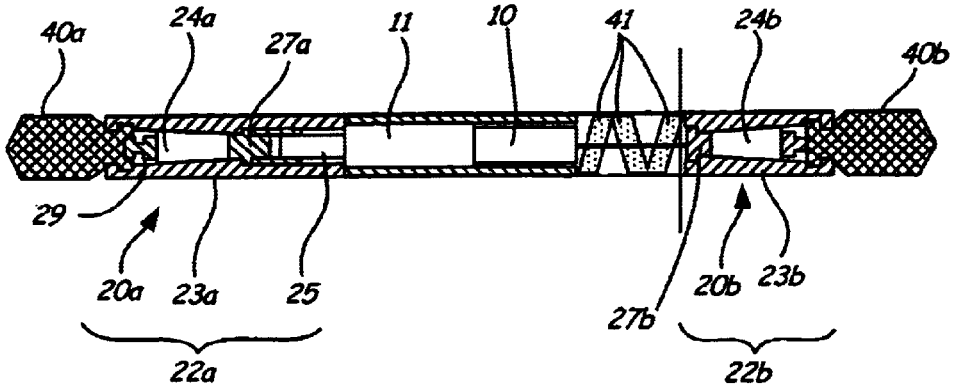
Figure 3:
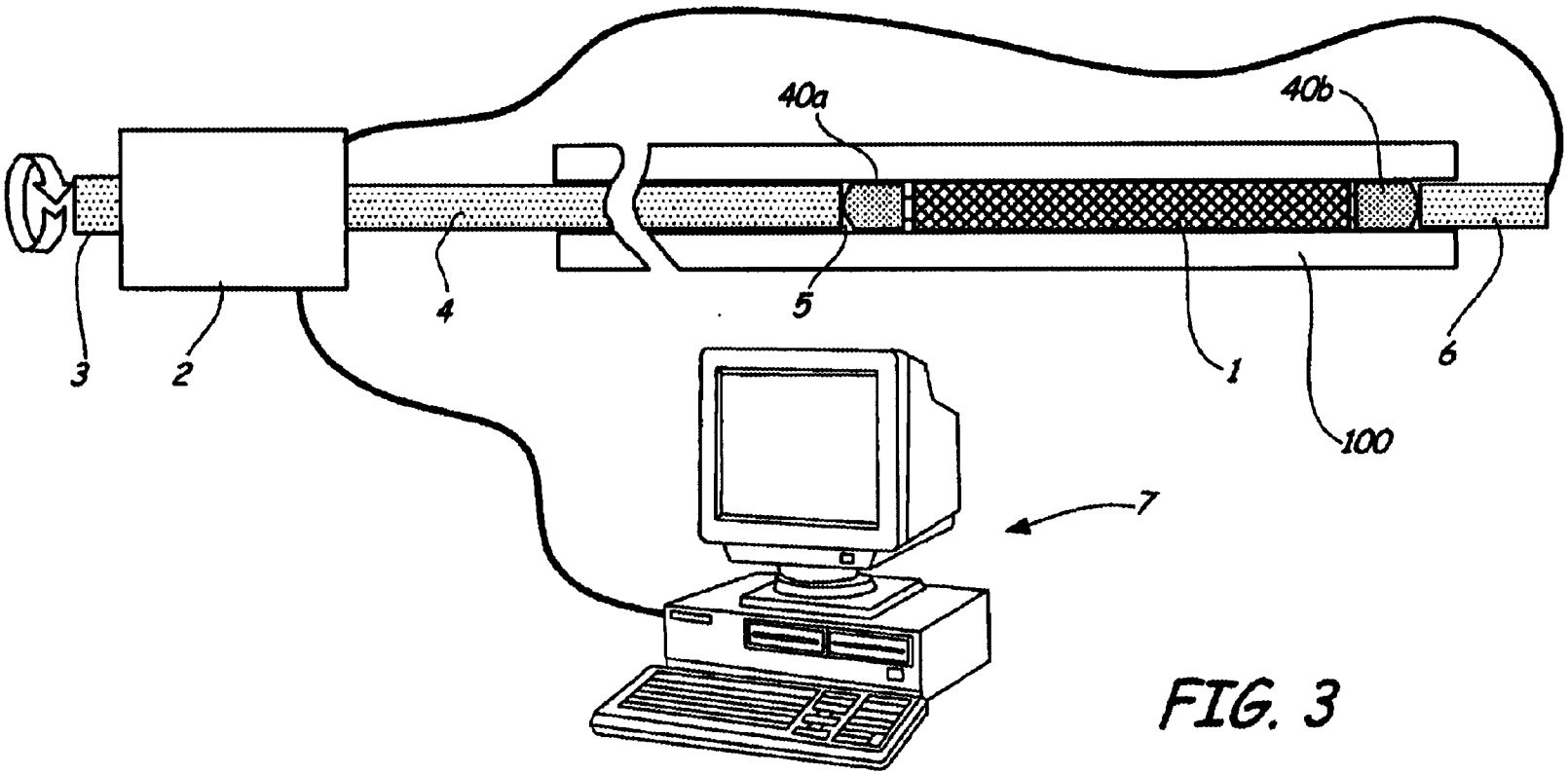

Preferred embodiments of the invention are illustrated exemplarily in the following FIGURES, in which:

FIG. 1 shows a schematic view of a first inventive embodiment of a one-piece safety device according to the invention, in particular for use in firearms;

FIG. 2*a* shows a schematic view of a second embodiment of a two-piece safety device according to the invention, in particular for use in firearms;

FIG. 2*b* shows a schematic view of a further embodiment of a two-piece safety device according to the invention which is slightly modified as compared to FIG. 2*a*; and FIG. 3 shows a schematic view of a preferred operating means according to the invention for operating a safety device according to the invention.

The same elements and elements having the same function bear the same reference signs in the Figures. FIGS. 1 and 2*a*/2*b* in particular show a safety device 1 according to the invention for securing a firearm against unauthorised use, said safety device preferably comprising a locking portion 20 or two locking portions 20*a* and 20*b* which is/are insertable into the barrel of a firearm that is not depicted and is/are optionally lockable therein and/or unlockable or is/are clampable to the barrel and/or detachable therefrom. The term "locking portion" designates a portion enabling positive and/or frictional engagement with the inside of a firearm barrel.

Preferably, the safety device is dimensioned such that the locking portions 20 can be arranged in the rear part of the barrel of a firearm so that the safety device may not be removed by simply sawing off the barrel and the insertion of a cartridge or opening and revolving the cylinder of a revolver may be prevented.

Moreover, a control unit 10 is provided that can authenticate a user and, upon authentication, locks and/or unlocks or clamps at least the locking portion 20 in the firearm barrel 100 (cf. FIG. 3) and/or makes the safety means detachable. Preferably, the control unit 10 is provided with an electronic means (not shown) that can authenticate a user. Authentication can for instance be effected electronically, (electro) magnetically, inductively, optically, mechanically and/or acoustically.

According to an embodiment of the invention, the safety device 1 is designed such that it is completely insertable into the barrel 100 and/or the cartridge chamber for securing the firearm. To this end, the safety device has to be smaller than the diameter of the barrel. Preferably, the safety device 1 is essentially cylindrical and thus has a smaller diameter than the inner diameter of the weapon barrel.

According to a further aspect of the invention, the safety device is provided with transmission means 40*a*, 21 for coupling it to an operating means 2–6 (cf. FIG. 3), by means of which a user can optionally lock and/or unlock the safety device 1 from outside or clamp it and/or make it detachable therefrom, Moreover, an activation means 26 is provided which, upon authentication by the control unit 10, enables or prevents locking and/or unlocking or clamping and detaching via the transmission means 40*a*.

This is preferably effected by a deactivation element 26 that has a movement from outside transmitted via an armouring 40*a* to a mechanism inside the safety device for operating said mechanism or prevents said transmission. This is preferably effected by coupling or decoupling or blocking the movement.

A further aspect of the invention relates to a severance protection means 41 that is arranged in or at the locking portion 20. The severance protection means 41 is provided with at least one tilted element 41 that is arranged in the locking portion 20, and is positioned and designed such that it at least partially radially expands the locking portion after locking or clamping if an essentially axial force caused by manipulation is applied so that the locking portion 41 is anchored farther inside the barrel 100 which is optionally even permanently damaged. Preferably, each side of the safety device 1 is provided with a severance protection means 41*a*, 41*b*. Moreover, each severance protection means 41 is provided with an expansibility that is graded to the outside if inserted. FIG. 2, for instance, shows that towards the outside, each severance protection means 41*a*, 41*b* is provided with a plate-shaped element with greatest thickness and, towards the inside, with a plate-shaped element with lowest thickness. If an axial force resulting from manipulation is applied, the elements of the severance protection means 41 with lower expansibility preferably generate the force necessary for expanding the elements with greater expansibility.

In a safety device 1 having an essentially circular inner diameter at the respective location, the plate-shaped elements of the severance protection means 41 may be inclined ovals that adapt to the inner diameter. In case of an axial force, these plate-shaped elements would be erect and would moreover expand the safety device 1 at these places and wedge it farther down the barrel.

Moreover, FIGS. 1 and 2*a*/2*b* show preferred embodiments of the safety device 1 according to the invention, said safety device comprising at least one armouring 40*a*, 40*b* protecting the safety device against unauthorised manipulation from outside.

Moreover, preferably, the safety device is provided with a first armouring 40*a* that protects the safety device within the barrel 100 against unauthorised manipulation from the barrel-muzzle end and a second armouring 40*b* that protects the safety device within the barrel 10 against unauthorised manipulation from the cartridge chamber end (cf. also FIG. 3).

Preferably, the armouring 40 comprises a ceramic material and/or diamond and, in a particularly preferred embodiment, is completely made of one of these materials. If an aforementioned preferred severance protection means 41 is provided, this severance protection means 41 absorbs an essentially axial mechanical energy that is manipulatively applied from outside to the armouring behind the armouring 40 such that the resultant force on the armouring 40 is reduced in order to prevent it from breaking into pieces. This is particularly advantageous with the aforementioned relatively fragile materials. Due to the presence of the severance protection means 41, the manipulatively applied mechanical energy is used to clamp the safety device 1 more tightly within the barrel. In a further preferred embodiment, the severance protection means 41 can be dimensioned such that, starting with a predetermined threshold value, the manipulatively applied mechanical energy is used to destroy the barrel.

Preferably, a locking portion 20 is provided with at least one clamping means 22 that is lockable within the barrel 100 of a weapon such that the safety device cannot be removed from the barrel 100. The locking portion 20 comprises at least one clamping means 22 that can preferably be activated from outside via an actuator 40*a*, 21, such as preferably the armouring 40*a* and a thread 27*a* connected thereto, unlocking being impossible unless an inactivation by the control unit 10 is lifted. The entire actuator 40*a*, 21 is activated from outside by rotating the armouring 40*a*. Preferably, the actuator 40*a*, 21 is provided with a predetermined breaking point 29 that is shaped and dimensioned such that the actuator 40*a*, 21 is permanently inactivated in case of an unauthorised manipulation (cf. FIGS. 1 and 2*b*).

In a further preferred embodiment as shown in FIGS. 1 and 2*b*, the actuator 21 is led through a bore in the expandable thread 27 or 27*a* and is connected with the latter near the deactivation element 26.

Preferably, the clamping means 22 is provided with at least one expandable clamping jaw 23, cf. FIG. 1. Additionally, a second clamping means 22 that is not operable from outside can be provided, as shown in FIGS. 2*a* and 2*b*.

The clamping means 22 is preferably provided with at least one expansion means 24 which expands the clamping jaw 23 or the clamping jaws 23*a*, 23*b* upon actuation of an actuator 40*a*, 21.

The expansion means 24 is preferably essentially arranged within the clamping jaw 23 and comprises, in a further preferred embodiment, at least one wedge surface that is movable with respect to a corresponding surface of the clamping jaw 23 so that the latter may be expanded. The expansion means 24 is preferably provided with at least one expanding thread 27 which may be moved axially with respect to the respective surface of the clamping jaw 23 by actuating the actuator 21.

The locking portion 20 is preferably provided with at least one clamping means that is clampable within the barrel 100 or the cartridge chamber (not shown) of a weapon, its clamping effect being increased as the force, such as a tension and/or pressure and/or rotation, applied to at least one end that is accessible from outside increases.

In a further preferred embodiment, an activation means 11, 25, 26 is provided with an actuator 11 that is controllable via the control unit, a spindle 25 that is rotatable via the actuator and a deactivation element 26 that is operable via the spindle 25, wherein, if operated, the deactivation element 26 prevents the expanding thread 27 from being rotated.

Furthermore, a mechanical potential that has to be overcome for actuating the deactivation element (preferably by means of a spring, not shown) prevents manipulation by shaking.

The control unit 10 is preferably provided with an electronic means 10 which essentially carries out a user authentication. Preferably, the electronic means 10 is supplied with energy from outside via an electric connection 12 (cf. FIG. 1). Via this connection 12, the authentication data are exchanged in a further preferred embodiment.

A further preferred embodiment is moreover provided with a means that inhibits/diverts the manipulatively applied electric and/or magnetic energy such that no opening is possible. In a further preferred embodiment, the inhibition/diversion means is an element for burning through or a fuse that inhibits or interrupts the current flow.

Alternatively or additionally, the inhibition/diversion means against manipulatively applied energy may be designed such that manipulatively applied energy is conducted past the actuator 11. As a further alternative, the inhibition/diversion means against manipulatively applied energy may be designed such that the manipulatively applied energy conducted to the actuator 11 by pre-adjustment such that it is actuated towards inactivation or activates the deactivation element 26.

According to the invention according to FIGS. 2*a* and 2*b*, a second locking section 20*b* may alternatively be provided which is insertable into and clampable or lockable within the barrel 100 of the firearm separately from the remaining safety device. Preferably, a second expanding thread 27*b* via which a second expanding cone 24*b* is axially movable is provided, the second expanding thread 27*b* being rotatable via its inner end. FIG. 2*b* illustrates the second locking portion 20*b* that is separated from the remaining safety device.

In this case, upon locking the second locking portion, the remaining safety device is inserted into the barrel 100 of the weapon up to the second locking portion 20*b* and locked. Locking may be effected to the barrel and/or the second locking portion. Afterwards, the second locking portion is no longer lockable/unlockable.

According to the invention, the second locking portion 20*b* may be designed such that it can be arranged in the cartridge chamber and/or the barrel 100.

A further aspect of the invention relates to an operating means 2–6, in particular for any of the aforementioned safety devices 1 (cf. FIG. 3). To this end, a coupling means 4, 5, 6 is provided for coupling the operating means to a transmission means 40*a* of the safety device 1 and for transmitting an authentication request to the safety device 1 and/or a force for locking and/or unlocking or clamping and detaching the safety device 1 from the barrel 100 and/or a cartridge chamber.

The coupling means 4, 5, 6 comprises an engagement means 5, the transmission means being established by an armouring 40*a* of the safety device 1 so that the engagement means 5 can engage with and rotate the armouring 40*a*. Preferably, the engagement means 5 is provided with claws matching the respective recesses in the armouring 40*a*.

Preferably, the coupling means 4, 5, 6 is provided with an electric contacting means 6 via which an authentication request can be transmitted to the safety device 1. In such an embodiment, the safety device 1 is provided with a respective connection, preferably within the armouring 40*b*.

In a further preferred embodiment, a gripping means 3 is provided to which a user can apply a rotation and which subsequently transmits the rotation via the coupling means 4 to the transmission means or the armouring 40*a* of the safety device 1. In such a case, a respective driving apparatus arranged, e.g., in a control means 2 is unnecessary although this variant, which is convenient for the user, is also possible. Preferably, the gripping means 3 is a turning actuation knob 3 which transmits the rotation applied by the user to a rod 4 and the armouring 40*a* and the thread 27*a* of the safety device 1 upon authentication of the user by the control unit 10.

In a further preferred embodiment, an electronic control unit 2 is provided which can be operated via a computer and, if necessary, transmits an authentication request to the electric contacting means 6. Moreover, safety devices 1 according to the invention could be programmed by the computer and the operating means 2–6. To this end, preferably proven crypto-algorithms can be used.

What is claimed is:

1. A firearms safety device for securing a firearm against unauthorised use, comprising:

at least one locking portion that is insertable into a barrel and/or a cartridge chamber of the firearm and is optionally lockable and/or unlockable therein and optionally clampable within and/or detachable from the barrel;

a control unit which is capable of authenticating a user and, upon authentication of the user, locks and/or unlocks or clamps at least the locking portion within the barrel of the firearm and or makes the safety device detachable;

the safety device being designed such that it is completely insertable into the barrel and/or the cartridge chamber for putting the firearm at safe;

wherein the control unit is electronic and is arranged within an area within the safety device which is protected against unauthorised manipulation.

2. A firearms safety device for securing a firearm against unauthorised use, comprising:

at least one locking portion that is insertable into a barrel and/or a cartridge chamber of the firearm and is optionally lockable and/or unlockable therein and optionally clampable within and/or detachable from the barrel;

a transmission means for coupling to an operating means via which a user can optionally lock and/or unlock or clamp said safety device from outside and/or make it detachable;

a control unit that is capable of authenticating a user; and an activation means which, upon authentication by the control unit, enables or prevents locking and/or unlocking or clamping and/or detaching via the transmission means;

wherein the control unit is electronic and is arranged inside the barrel and/or the cartridge chamber and therefore within an area protected against unauthorised manipulation.

3. A firearms safety device for securing a firearm against unauthorised use, comprising:

at least one locking portion that is insertable into a barrel and/or a cartridge chamber of the firearm and is optionally lockable and/or unlockable therein and optionally clampable within and/or detachable from the barrel;

a severance protection that is arranged in the locking portion and comprises at least one inclined element provided in said locking portion which inclined element is designed and positioned such that it expands the locking portion upon locking or clamping at least partially radially in case of an essentially axial force caused by manipulation so that the locking portion is locked or clamped even farther down the barrel and/or the cartridge chamber;

a control unit that is capable of authenticating a user;

wherein the control unit is electronic and is arranged inside the barrel and/or the cartridge chamber and therefore within an area protected against unauthorised manipulation.

4. The safety device according to claim 2, wherein the activation means comprises a deactivation means.

5. The safety device according to claim 3, wherein the severance protection means is provided with a plurality of plate-shaped, inclined elements with graded expansibility.

6. The safety device according to claim 5, wherein the elements with lower expansibility generate a counterforce that is necessary to expand the elements with higher expansibility in case of an axial force caused by manipulation.

7. The safety device according to claim 1 wherein the safety device is provided with at least one armouring which protects the safety device against unauthorised manipulation from outside.

8. The safety device according to claim 1, wherein said safety device is provided with a first armouring protecting said safety device, if inserted into the barrel, against unauthorised manipulation from the barrel-muzzle end and a second armouring protecting said safety device, if inserted into the barrel, against unauthorised manipulation from the cartridge chamber end.

9. The safety device according to claim 7, wherein at least one armouring is provided with a ceramic material or diamond.

10. The safety device according to claim 7, wherein an essentially axial mechanical energy manipulatively applied from outside to the armouring is absorbed by means behind the armouring such that the resultant force on the armouring is reduced which is thus prevented from breaking into pieces.

11. The safety device according to claim 10, wherein the safety device is designed such that the manipulatively applied mechanical energy is used to increase the clamping force applied to the safety device within the barrel.

12. The safety device according to claim 10, wherein the safety device is designed such that the manipulatively applied mechanical energy is used to destroy the barrel.

13. The safety device according to claim 10, wherein the means for absorbing the essentially axial mechanical energy is part of the armouring itself.

14. The safety device according to claim 1, wherein the locking portion is provided with at least one clamping means that is lockable within the barrel of a weapon such that the safety device cannot be removed from the barrel.

15. The safety device according to claim 1, wherein the locking portion is provided with at least one clamping means that can be actuated from outside via an actuator, wherein unlocking is possible only if an inactivation is lifted by the control unit.

16. The safety device according to claim 15, wherein the actuator is designed such that it merely gives the user the necessary degree of freedom for an authorised actuation of the locking portion from outside and, if not activated, this degree of freedom cannot be used for removing or manipulating the safety device.

17. The safety device according to claim 15, wherein the actuator is provided with a predetermined breaking point that is designed and dimensioned such that the actuator is permanently inactivated in case of an unauthorised manipulation.

18. The safety device according to claim 15, wherein armouring is part of the actuator.

19. The safety device according to claim 17, wherein an actuation can be established by rotating armouring.

20. The safety device according to claim 14, wherein the clamping means comprises at least one expandable clamping jaw.

21. The safety device according to claim 20, wherein the clamping means comprises at least one expanding means that expands the clamping jaw(s) upon actuation of the actuator.

22. The safety device according to claim 21, wherein the expanding means is provided essentially within the clamping jaw and comprises at least one wedge surface that is movable with respect to a respective surface of the clamping jaw so that it can be expanded.

23. The safety device according to claim 21, wherein the expanding means comprises at least one expanding thread which can be moved axially with respect to the respective surface of the clamping jaw by actuation of the actuator.

24. The safety device according to claim 1, wherein the clamping portion is provided with at least one clamping means that is clampable within the barrel/cartridge chamber of a weapon, wherein its clamping effect is increased as the force, such as tension, pressure and/or rotation, applied to an end accessible from outside increases.

25. The safety device according to claim 1, wherein an activation means comprises an actuator that is controllable via a control unit, a spindle that is rotatable via the actuator and a deactivation element that is operable via the spindle, wherein, if operated (the safety device being in a state in which it cannot be removed), the deactivation element prevents an expanding thread from being rotated.

26. The safety device according to claim 25, wherein a mechanical potential has to be overcome for operating the deactivation element.

27. The safety device according to claim 1, wherein the control unit comprises electronic means that essentially authenticates a user.

28. The safety device according to claim 27, wherein the electronic means is supplied with energy from outside via an electric connection, preferably galvanically, capacitatively or inductively.

29. The safety device according to claim 28, wherein the authentication data are also exchanged via said connection.

30. The safety device according to claim 1, wherein a device is provided that inhibits/diverts the manipulatively applied electric energy such that no opening is possible.

31. The safety device according to claim 30, wherein the device inhibiting/diverting manipulatively applied energy comprises an element for blowing in case of manipulatively applied energy, which inhibits or interrupts the current supply.

32. The safety device according to claim 30, wherein the device inhibiting/diverting manipulatively applied energy is designed such that manipulatively applied energy is led past the actuator.

33. The safety device according to claim 30, wherein the device inhibiting/diverting manipulatively applied energy is designed such that manipulatively applied energy is preset to be led to the actuator such that it is operated towards inactivation.

34. The safety device according to claim 1, wherein a second actuator and a second expanding thread are provided via which and via a respective inner thread in a second expanding cone said second expanding cone is axially movable and wherein said second expanding thread is rotatable via its inner end.

35. The safety device according to claim 1, wherein a second locking portion, which is at first separate from the remaining safety device, is insertable into and clampable or lockable within the barrel of the weapon, wherein said second locking portion is no longer de-clampable/unlockable upon insertion of the first locking portion.

36. The safety device according to claim 35, wherein the remaining safety device is insertable into the barrel of the weapon up to the second locking portion, wherein the remaining safety device can be clamped/locked with the barrel and/or the second locking portion.

37. The safety device according to claim 35, wherein the second locking portion is designed such that it can be arranged within the cartridge chamber and the barrel.

38. Safety device according to claim 1, further comprising:

operating means for coupling the operating means to a transmission means of the safety device and for transmitting an authorisation request to the safety device and/or a force for locking and/or unlocking or clamping and/or removing the safety device from the barrel and/or the cartridge chamber.

39. The operating means according to claim 38, wherein the coupling means comprises an engagement means and the transmission means is formed by an armouring of the safety device so that the engagement means (5) can engage with and rotate the armouring.

40. The operating means according to claim 39, wherein the coupling means comprises contacting means via which an authorisation means is transmitted to the safety device.

41. The operating means according to claim 40, moreover comprising gripping means which a user can rotate and which subsequently transmits the rotation to the transmission means of the safety device via the coupling means.

42. The operating means according to claim 38 which is capable of examining whether the safety device has been correctly inserted according to predetermined criteria by monitoring the mechanical parameters during operation and/or by reply from the control unit.

43. The operating means according to claim 38 comprising an electronic control means that is programmable by a computer and, if necessary, transmits the authorisation request to the contacting means.

44. A method for securing a firearm against unauthorised use, in particular comprising a safety device according to claim 1, comprising the following steps:

providing at least one locking portion;

inserting the entire safety device and the locking portion into the barrel and/or the cartridge chamber of the firearm:

providing a control unit authenticating the user and, if the user is authorised, locking and/or unlocking or clamping the locking portion in the barrel of the firearm and/or detaching the safety device;

transmitting an authentication code to the control unit; and optionally locking and/or unlocking or optionally clamping the locking portion and/or removing the safety device from the barrel.

45. A method for securing a firearm against unauthorised use, in particular comprising a safety device according to claim 1, comprising the following steps:

providing at least one locking portion;

providing a control unit that is capable of authenticating a user and, if the user is authorised, locks and/or unlocks or clamps at least the locking portion in the barrel of the firearm and/or makes the safety device detachable; and providing an activation means which, upon authentication by the control unit, enables or prevents locking and/or unlocking or clamping and/or detachment via the transmission means.

46. A method for securing a firearm against unauthorised use, in particular comprising a safety device according to claim 1, comprising the following steps:

providing at least one locking portion;

inserting the safety device and the locking portion into the barrel and/or the cartridge chamber of the firearm; and providing a severance protection means in the locking portion, wherein the severance protection means comprises at least one inclined element within the locking portion which is positioned and designed such that it at least partially radially expands the locking portion upon locking or clamping in case of an essentially axial force caused by manipulation so that the locking portion is locked or clamped farther down in the barrel and/or the cartridge chamber.

* * * * *